US007369784B2

(12) United States Patent
Ishihara et al.

(10) Patent No.: US 7,369,784 B2
(45) Date of Patent: May 6, 2008

(54) IMAGE FORMING APPARATUS AND MAIN BODY OF THE SAME

(75) Inventors: Eiji Ishihara, Ebina (JP); Tomohisa Suzuki, Ebina (JP); Hiroshi Kikuchi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/226,723

(22) Filed: Sep. 14, 2005

(65) Prior Publication Data

US 2006/0204250 A1 Sep. 14, 2006

(30) Foreign Application Priority Data

Mar. 10, 2005 (JP) ..... 2005-067031
Mar. 24, 2005 (JP) ..... 2005-086025

(51) Int. Cl.
*G03G 15/00* (2006.01)

(52) U.S. Cl. ..... 399/12; 399/24

(58) Field of Classification Search ..... 399/12, 399/24

See application file for complete search history.

(56) References Cited

U.S. PATENT DOCUMENTS 6,512,894 B2 * 1/2003 Takemoto et al. ..... 399/12
6,748,182 B2 * 6/2004 Yoshida et al. ..... 399/12
6,978,255 B1 * 12/2005 Pauschinger et al. ..... 705/61
7,221,878 B2 * 5/2007 Chen ..... 399/12
2003/0031475 A1 * 2/2003 Asakura ..... 399/12
2005/0078165 A1 * 4/2005 Harada et al. ..... 347/137
2006/0188270 A1 * 8/2006 Chen ..... 399/12

FOREIGN PATENT DOCUMENTS

JP 2003-084631 3/2003

OTHER PUBLICATIONS

Copy of Office Action in corresponding Chinese Patent Appl. No. 2005100992864 on Nov. 9, 2007, with English translation.

* cited by examiner

*Primary Examiner*—David M. Gray
*Assistant Examiner*—Bryan Ready
(74) *Attorney, Agent, or Firm*—Gauthier & Connors LLP

(57) ABSTRACT

The present invention provides an image forming apparatus main body for forming an image on a recording medium using consumable items removably attached thereto by at least two operation modes. The image forming apparatus main body comprises a communicating unit that communicates with a consumable item which retains switching information to change the operation mode of the image forming apparatus main body and a controller that switches among the operation modes according to the switching information retained in the consumable item when the consumable item is attached to the image forming apparatus main body, and restores the previous operation mode before switching when a predetermined validity condition has fulfilled.

14 Claims, 11 Drawing Sheets

INFORMATION IN CONSUMABLE ITEM MEMORY 21

| | CONSUMABLE ITEM CODE | |
|---|---|---|
| NORMAL PRICE ITEM 20A | A | |
| DISCOUNT ITEM 20B | B | |
| SWITCHING ITEM 20C | C | NUMBER OF ALLOWED USES (VALIDITY CONDITION INFORMATION) |
| UNAPPROVED ITEM 20D | NONE | |

Fig. 3

INFORMATION IN CONSUMABLE ITEM MEMORY 121

| | CONSUMABLE ITEM CODE | |
|---|---|---|
| NORMAL ITEM 120A | AA | |
| DISCOUNTED ITEM 120B | BB | SERIAL NUMBER (UPPER 4 DIGITS REPRESENT IDENTIFICATION INFORMATION) |
| REGISTRATION ITEM 120C | CC | SERIAL NUMBER (PERMISSION INFORMATION) |
| UNAPPROVED ITEM 120D | NONE | |

Fig. 10

IMAGE FORMING APPARATUS AND MAIN BODY OF THE SAME

PRIORITY INFORMATION

This application claims priority to Japanese Patent Application No. 2005-067031, filed Mar. 10, 2005 and, Japanese Patent Application No. 2005-086025, filed Mar. 24, 2005, which are incorporated herein by reference in their entireties.

BACKGROUND OF THE INVENTION

1. Field of the Invention

The present invention relates to an image forming apparatus in which an image forming apparatus main body forms an image on a recording medium using a consumable item removably attached thereto.

2. Description of the Related Art

As a method of switching an operation mode of an image forming apparatus, such as a copier, a printer, or the like, there has conventionally been known a switching method achieved using a service tool (such as, for example, a service mode of a control panel, a special-purpose jig, dedicated PC, or the like) by a customer engineer (CE) who has expert knowledge. Such a switching method is adopted in a case where the changing of operation mode arbitrarily achieved by a user is not desired.

The above-described method is, however, inconvenient for users because they are required to call a CE every time the need to change the operation mode arises. A manufacturer or a dealer is, on the other hand, required to send a CE to an installation site of the apparatus every time the operation mode is switched, which is very costly for them.

SUMMARY OF THE INVENTION

The present invention provides an image forming apparatus main body for forming an image on a recording medium using consumable items removably attached thereto by at least two operation modes. The image forming apparatus main body comprises a communicating unit that communicates with a consumable item which retains switching information to change the operation mode of the image forming apparatus main body and a controller that switches among the operation modes according to the switching information retained in the consumable item when the consumable item is attached to the image forming apparatus main body, and restores the previous operation mode before switching when a predetermined validity condition has fulfilled.

According to a further aspect, the present invention also provides an image forming apparatus for forming an image on a recording medium using consumable items removably attached thereto by at least two operation modes. The image forming apparatus comprises a consumable item that retains switching information to change the operation mode of the image forming apparatus and a controller that switches among the operation modes according to the switching information retained in the consumable item when the consumable item is attached to the image forming apparatus, and restores the previous operation mode before switching when a predetermined validity condition has fulfilled.

According to a still further aspect, the present invention provides an image forming apparatus in which an image forming apparatus main body forms an image on a recording medium using a consumable item removably attached to the image forming apparatus main body, wherein, in addition to an ordinary consumable item, a special consumable item which prestores identification information for usage control and a consumable item for permission information registration which prestores permission information indicating at least one set of the identification information are provided as one of the consumable items. When the consumable item for permission information registration is attached, the image forming apparatus main body retrieves the identification information from the attached consumable item, and registers and retains the retrieved identification information, while when the special consumable item is attached, the image forming apparatus main body retrieves the identification information from the attached special consumable item, and determines whether or not the retrieved identification information matches any one of the at least one set of identification information indicated by the registered and retained permission information, and then imposes a predetermined functional restriction when matching is not determined, or does not impose the predetermined functional restriction when matching is determined.

According to further aspect, the present invention provides an image forming apparatus main body which forms an image on a recording medium using a consumable item removably attached thereto, wherein, in addition to an ordinary consumable item, a special consumable item which prestores identification information for usage control and a consumable item for permission information registration which prestores permission information indicating at least one set of the identification information can be installed as one of the consumable items. When the consumable item for permission information registration is attached, the image forming apparatus main body retrieves the permission information from the attached consumable item, and registers and retains the permission information, while when the special consumable item is attached, the image forming apparatus main body retrieves the identification information from the attached special consumable item, and determines whether or not the identification information matches any one of the at least one set of the identification information indicated by the registered and retained permission information, and then imposes a predetermined functional restriction when matching is not determined, or does not impose the predetermined functional restriction when the matching is determined.

BRIEF DESCRIPTION OF THE DRAWINGS

Embodiments of the present invention will be described in detail based on the following figures, wherein:

FIG. 3 is a diagram showing information stored in a consumable item memory;

FIG. 10 is a diagram showing information stored in a consumable item memory.

DESCRIPTION OF THE PREFERRED EMBODIMENTS

Figure 1:
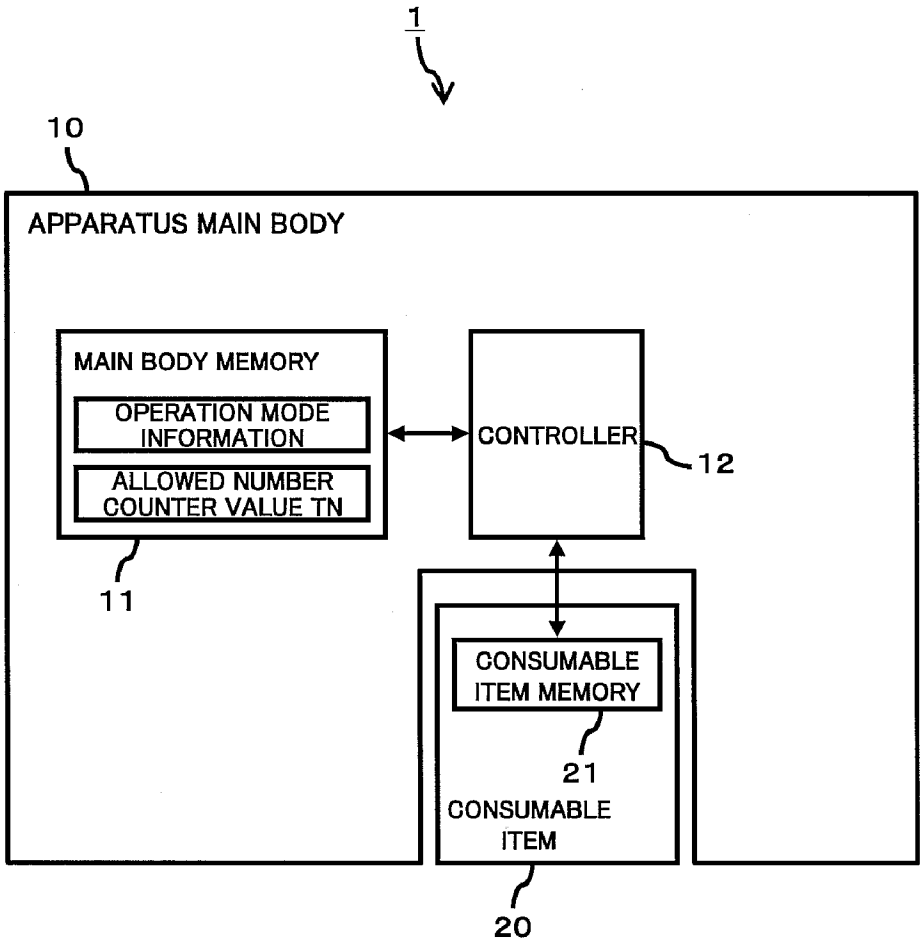
FIG. 1 is a block diagram showing a configuration of an image forming apparatus according to a first embodiment of the present invention.

Referring now to the drawings, embodiments of the present invention will be described below.

Embodiment 1

FIG. 1 is a block diagram showing a configuration of an image forming apparatus 1 according to a first embodiment of the present invention. The image forming apparatus 1 forms an image on a recording medium, such as, for example, paper, similarly to a copier, a printer, a facsimile machine, a digital multifunction device, and the like. A printing scheme of the image forming apparatus 1 includes, for example, an electrophotographic printing method, an inkjet method, and others.

In FIG. 1, the image forming apparatus 1 includes an image forming apparatus main body (hereinafter abbreviated as "apparatus main body") 10, and a consumable item 20 removably, attached to the apparatus main body 10. The apparatus main body 10 cooperates with the consumable item 20 to form an image.

The apparatus main body 10 is a substantially stationary part in the image forming apparatus 1, while the consumable item 20 is generally a replacement part to be appropriately replaced when depleted, and may include, for example, a photosensitive unit, a toner bottle, an ink cartridge, and the like.

Figure 2:
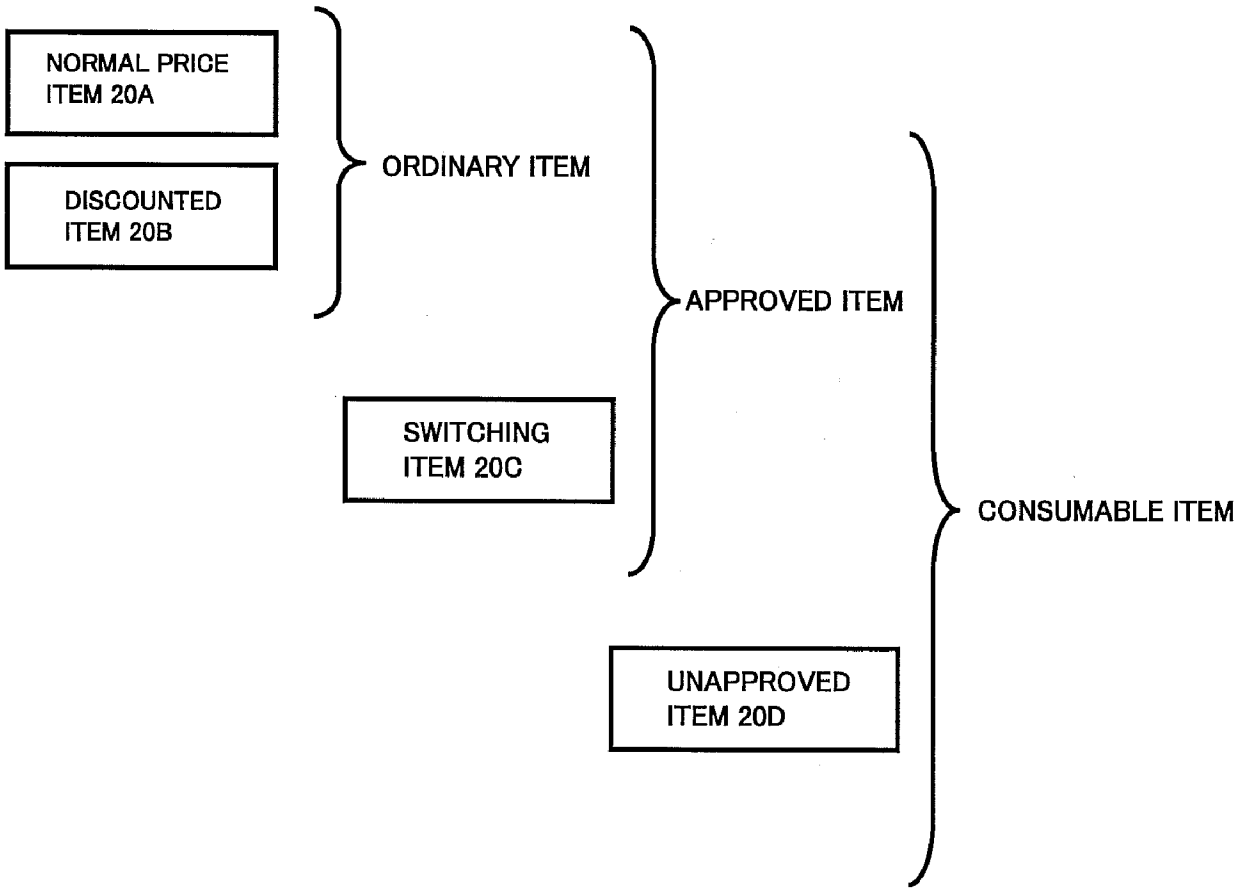
FIG. 2 is a diagram showing types of consumable items in the first embodiment.

FIG. 2 is a diagram showing types of the consumable item 20 according to the present Embodiment 1. The types of the consumable item 20 and an operation mode of the apparatus main body 10 will be described with reference to FIG. 2 below.

In Embodiment 1, the consumable item 20 is offered to a bulk purchasing consumer (a large account, a heavy user) at a discounted price lower than a normal price. Accordingly, the consumable item 20 is classified as shown in FIG. 2 into a normal-price consumable item (hereinafter referred to as "normal price item") 20A supplied at a normal price and a discounted consumable item (hereinafter referred to as "discounted item") 20B supplied at a reduced price to the bulk purchasing consumer.

In a sales form for offering a consumable item at a discounted price to a bulk purchasing consumer, because the discounted item 20B is supplied at a low price on condition that the discounted item 20B is purchased in large volume, it is undesirable for the discounted item 20B offered to the bulk purchasing consumer to be diverted for use by other ordinary consumers. In this embodiment, to prevent the diversion of the discounted item 20B to an ordinary consumer, the apparatus main body 10 is provided, as operation modes, with a standard mode in which a functional restriction is imposed when the discounted item 20B is attached, and a bulk purchasing consumer mode in which the functional restriction is not imposed when the discounted item 20B is attached. Here, taking into account a discount rate or the like, functions to be restricted may be determined as appropriate, and the functional restriction may include partially disabling the functions of the image forming apparatus 1 except for an image forming capability, partially disabling the functions of the image forming apparatus 1 including the image forming capability, and entirely disabling all of the functions of the image forming apparatus 1.

From the viewpoint of preventing the diversion of the discounted item 20B to an ordinary consumer, it is undesirable that a user is allowed to arbitrarily switch from the standard mode to the bulk purchasing consumer mode. However, the setting in which the switching is performed by a CE will bring about an inconvenience to the user, while placing a costly burden on a manufacturer or a dealer (hereinafter referred to as "a dealer or the like") as described above. Accordingly, in Embodiment 1, the switching from the standard mode to the bulk purchasing consumer mode is determined to be achieved through the operation of attaching the consumable item 20. In other words, the consumable item 20 is used as a tool for switching between the operation modes. Specifically, as shown in FIG. 2, as one of the consumable item 20, a consumable item for switching (hereinafter referred to as "a switching item") 20C used for changing the operation mode of the apparatus main body 10 is provided in addition to an ordinary consumable item (here, including the normal price item 20A and the discounted item 20B) which does not have a switching capability.

The normal price item 20A, the discounted item 20B, and the switching item 20C are consumable items, such as genuine parts, recommended parts, and the like, the use of which is approved by a manufacturer of the apparatus main body 10 (hereinafter referred to as "an approved item"). On the actual market, there have been distributed, as well as the approved items, third-vendor parts, third-party parts, counterfeits, fakes, pirated goods, etc., which are consumable items 20D whose use is not approved by the manufacturer of the apparatus main body 10 (hereinafter referred to as "an unapproved item").

Referring again to FIG. 1, the configuration of the image forming apparatus 1 will be described in further detail below. As shown in FIG. 1, the consumable item 20 is equipped with a consumable item memory 21 which is a nonvolatile storage device. Here, the consumable item memory 21 is a semiconductor memory contained in an RFID (Radio Frequency Identification) tag, and data is read or written through wireless communication from or into the consumable item memory 21. In addition, the consumable item memory 21 also works as a memory in which control information, such as a collection value for compensating unevenness in production quality, a usage history, and the like is stored.

FIG. 3 is a diagram showing information stored in the consumable item memory 21. The consumable item memories 21 of the normal price item 20A, the discounted item 20B, and the switching item 20C store their respective consumable item codes "A", "B", and "C" each representing a type of the consumable item as shown in FIG. 3. The consumable item code "C" stored in the consumable item memory 21 of the switching item 20C functions as switching information to change the operation mode. The consumable item memory 21 of the switching item 20C further stores the number of allowed uses of the discounted item 20B as validity condition information indicating a validity condition of the operation mode (which is, here, the bulk purchasing consumer mode) after switching. Specifically, the validity condition information is validity period information indicating a validity period of the operation mode after switching. The unapproved item 20D, on the other hand, does not have a consumable item code assigned thereto. Further, there might be an unapproved item 20D which does not have a memory like the consumable item memory 21.

The apparatus main body 10 has a main body memory 11 and a controller 12 as shown in FIG. 1. The main body memory 11 is a storage device which retains information on a current operation mode (hereinafter referred to as "operation mode information") and an allowed number counter value TN representing the number of discounted items 20B usable in the bulk purchasing consumer mode, and may be a rewritable nonvolatile storage device, such as an NVRAM (Non Volatile RAM), a nonvolatile register, or the like. In a factory-shipped state of the apparatus main body 10, the operation mode information in the main body memory 11 is established as the standard mode.

The controller 12 controls the entire image forming apparatus 1 including a print engine and a user interface which are not illustrated. In the present Embodiment 1, when the switching item 20C is attached, the controller 12 switches between the operation modes according to the switching information stored in the attached switching item 20C, and thereafter restores the previous operation mode before switching when a predetermined validity condition has fulfilled. More specifically, when the switching item 20C is attached in the standard mode, the controller 12 obtains the consumable item code "C" and the number of allowed uses from the switching item 20C, and switches the operation mode from the standard mode to the bulk purchasing consumer mode based on the consumable item code "C". Then, when the use of the discounted item 20B equivalent to the number of allowed uses is completed, the controller 12 restores the operation mode from the bulk purchasing consumer mode to the standard mode. Further, when the switching item 20C is attached in the bulk purchasing consumer mode, the controller 12 retrieves the number of allowed uses from the attached switching item 20C, switches between the operation modes, and thereafter restores the operation mode to the standard mode at the time when the use of the discounted item 20B equivalent to the sum of the number of allowed uses obtained in the standard mode and that obtained in the bulk purchasing consumer mode is completed.

Here, the controller 12 is a circuit substrate equipped with a CPU, a ROM, a RAM, etc., and the function of the controller 12 can be implemented by causing the CPU to run a program stored in a storage medium, such as the ROM. However, a method of implementing the function of the controller 12 is not specifically limited, and the function may be implemented, for example, by a dedicated hardware circuit.

Figure 4:
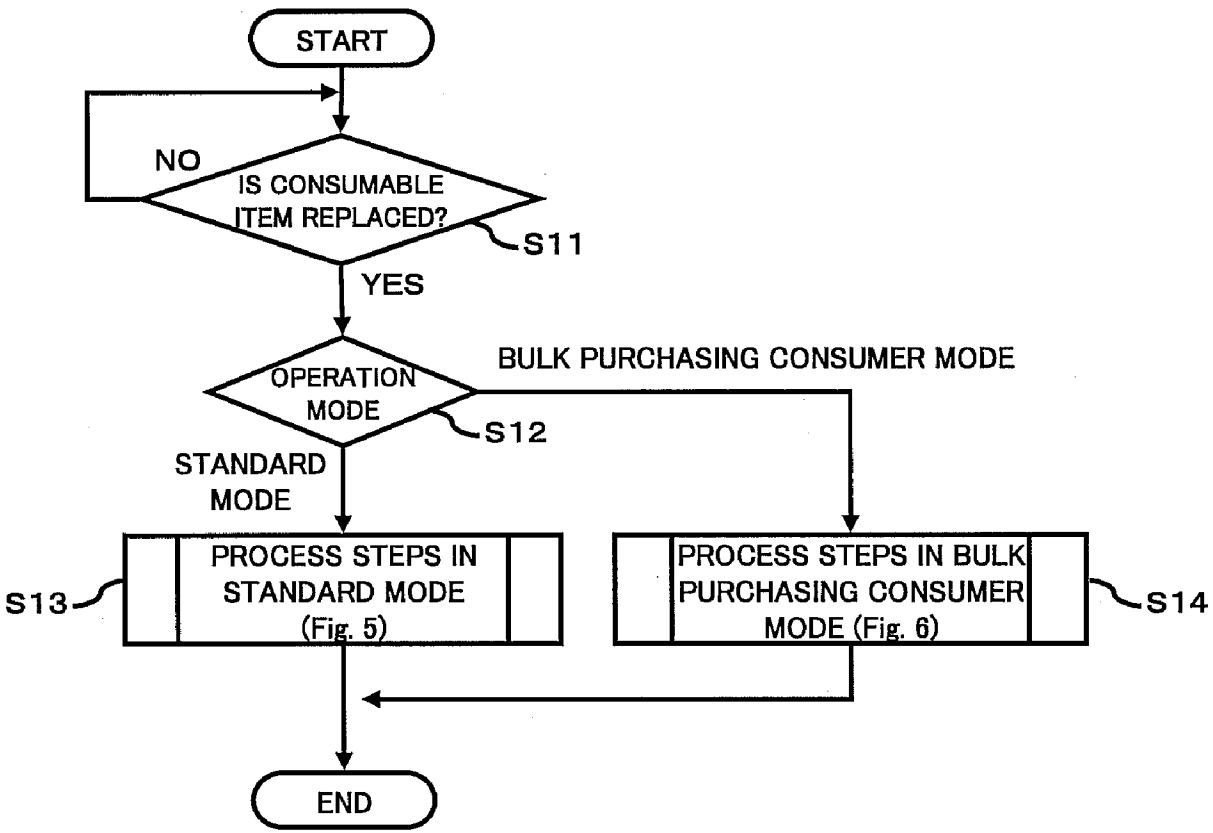
FIG. 4 is a flowchart showing an operation procedure of a controller.
Figure 5:
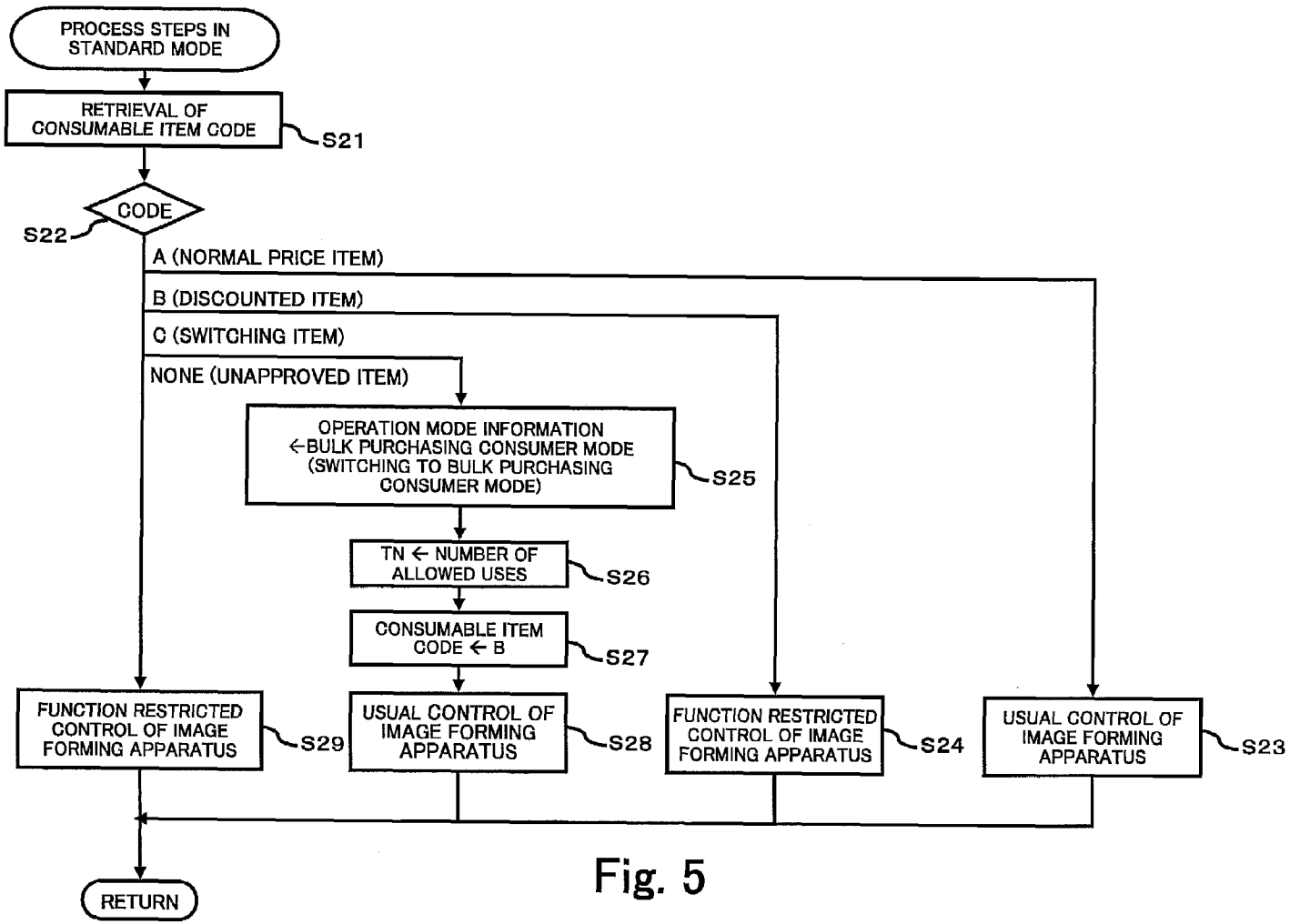
FIG. 5 is a flowchart showing process steps in a standard mode.
Figure 6:
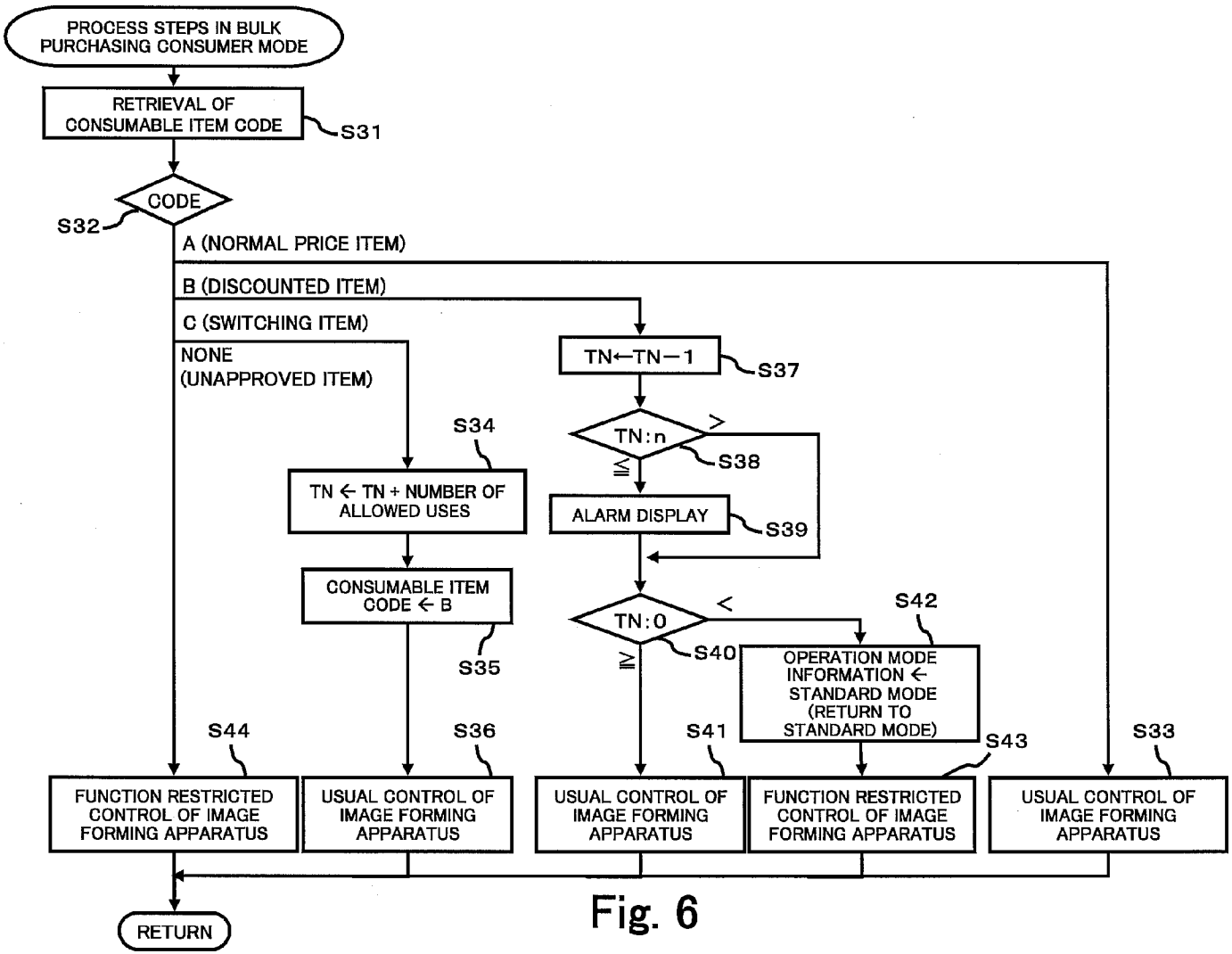
FIG. 6 is a flowchart showing process steps in a bulk purchasing consumer mode.

FIG. 4 is a flowchart showing operation procedure of the controller 12. FIG. 5 is a flowchart showing process steps in the standard mode, while FIG. 6 is a flowchart showing process steps in the bulk purchasing consumer mode. Referring to FIGS. 4 to 6, operation of the image forming apparatus 1 will be described in detail below. As general image forming operation of the image forming apparatus 1 is commonly known, description thereof is not provided below.

In FIG. 4, when replacement of the consumable item 20 is detected by an appropriate detector (Yes in S11), the controller 12 refers to operation mode information retained in the main body memory 11 to determine a current operation mode (S12). When the current operation mode is determined to be the standard mode, the controller 12 performs process steps in the standard mode shown in FIG. 5 (S13), or performs process steps in the bulk purchasing customer mode shown in FIG. 6 when the current operation mode is determined to be the bulk purchasing customer mode (S14). The process steps in the standard mode and those in the bulk purchasing customer mode will be described in succession below.

[Process Steps in Standard Mode]

In FIG. 5, the controller 12 reads the consumable item code from the consumable item memory 21 of the consumable item 20 through a communicating unit (not illustrated) (S21) and determines the consumable item code of the attached consumable item 20 (S22). For example, the communicating unit is a reader/writer.

If the consumable item code is "A" (A in S22), i.e. when the normal price item 20A is attached, the controller 12 thereafter controls the image forming apparatus 1 in the usual way while imposing no functional restrictions (S23). When the normal price item 20A is attached in the standard mode as described above, the image forming apparatus 1 operates with all of the functions activated until the next replacement of the consumable item is performed.

If the consumable item code is "B" (B in S22), i.e. when the discounted item 20B is attached, the controller 12 thereafter controls the image forming apparatus 1 while imposing a predetermined functional restriction (S24). Here, the controller 12 maintains the image forming capability in its enabled state, but disables additional functions other than the image forming capability. The functions to be disabled here are appropriately determined taking into account the discount rate and others. As such, when the discounted item 20B is attached in the standard mode, the image forming apparatus 1 operates with only limited functions activated until the next replacement of the consumable item is performed.

If the consumable item code is "C" (C in S22), i.e. when the switching item 20C is attached, the controller 12 overrides the operation mode information in the main body memory 11 from the standard mode to the bulk purchasing consumer mode (S25) to thereby switch the operation mode of the apparatus main body 10 from the standard mode to the bulk purchasing consumer mode. Then, the controller 12 retrieves the number of allowed uses from the consumable item memory 21 and assigns the retrieved number of allowed uses to the allowed number counter value TN (S26). Accordingly, when the number of allowed uses specified in the switching item 20C is "5", for example, a value of 5 is set for the allowed number counter value TN in the main body memory 11. Next, the controller 12 rewrites the consumable item code retained in the consumable item memory 21 replacing "C" with "B" (S27). Consequently, the switching information and the number of allowed uses retained in the switching item 20C become invalid, and the number of times the switching item 20C is used as a consumable item for switching is limited to one time. Once these process steps are completed, the controller 12 controls the image forming apparatus 1 in the usual way without imposing the functional restriction (S28). As described above, when the switching item 20C is attached in the standard mode, the operation mode transits from the standard mode to the bulk purchasing consumer mode, and the image forming apparatus 1 operates with all of the functions activated until the next replacement of the consumable item is performed.

When the consumable item code is not retrieved (none in S22), i.e. when the unapproved item 20D is attached, the controller 12 thereafter controls the image forming apparatus 1 while imposing the predetermined functional restriction (S29). Here, the controller 12 maintains the image forming capability in its enabled state, but disables the other additional functions. The functions to be disabled here are determined appropriately in view of preventing disadvantages associated with the use of the unapproved item 20D (a failure of the apparatus main body 10, a problem of poor image quality, a degraded safety level). The functional restriction imposed in step S29 may either be similar to or different from that imposed in the previous step S24. As such, when the unapproved item 20D is attached in the standard mode, the image forming apparatus 1 operates with only the limited functions activated until the next replacement of the consumable item is performed.

[Process Steps in Bulk Purchasing Consumer Mode]

In FIG. 6, the controller 12 retrieves the consumable item code from the consumable item memory 21 in the consumable item 20 through a communicating unit which is not illustrated (S31), and determines the consumable item code of the attached consumable item 20 (S32).

If the consumable item code is "A" (A in step S32), i.e. when the normal price item 20A is attached, the controller thereafter controls the image forming apparatus 1 in the usual way without imposing the functional restriction (S33). When the normal price item 20A is attached in the bulk purchasing consumer mode, the image forming apparatus 1 operates with all of the functions activated until the next replacement of the consumable item is performed.

If the consumable item code is "C" (C in S32), i.e. when the switching item 20C is attached, the controller 12 retrieves the number of allowed uses from the consumable item memory 21 and adds the retrieved number of allowed uses to the allowed number counter value TN (S34). For example, if the switching item 20C retaining the number of allowed uses of "5" is attached and the allowed number counter value TN is "5", the allowed number counter value TN is increased to "10". In other words, five discounted items are added to the discounted items 20B that can be used in the bulk purchasing consumer mode. The controller 12 then rewrites the consumable item code retained in the consumable item memory 21 replacing "C" with "B" (S35). As a result, the switching information and the number of allowed uses retained in the switching item 20C becomes void, and the number of times the switching item 20C can be used as the consumable item for switching is limited to one time. Once these process steps are completed, the controller 12 thereafter controls the image forming apparatus 1 in the usual way without restricting the functions (S36). When the switching item 20C is attached in the bulk purchasing consumer mode, the image forming apparatus 1 increases the number of allowed uses, and thereafter operates with all of the functions activated until the next replacement of the consumable item is performed.

If the consumable item code is "B" (B in S32), i.e. when the discounted item 20B is attached, the controller 12 decrements the allowed number counter value TN in the main body memory 11 (S37).

Then, the controller 12 determines whether or not the allowed number counter value TN is smaller than or equal to a predetermined value n (where n is an integer greater than zero or zero) (S38). If the allowed number counter value TN is the predetermined value n or smaller, the controller 12 notifies that the number of discounted items 20B usable in the bulk purchasing consumer mode is low by means of screen display, voice, sound, or the like (S39). If the allowed number counter value TN is greater than the predetermined value n, on the other hand, the controller 12 does not provide the above notification.

Next, the controller 12 determines whether or not the allowed number counter value TN is greater than or equal to zero (S40). When the allowed number counter value TN is zero or greater, the controller 12 controls the image forming apparatus 1 in the usual way without restricting the functions (S41) because the validity condition of the bulk purchasing consumer mode has not fulfilled. When the allowed number counter value TN is smaller than zero, on the other hand, the controller 12 overrides the operation mode information in the main body memory 11 from the bulk purchasing consumer mode to the standard mode (S42) because the validity condition of the bulk purchasing consumer mode has fulfilled, to thereby switch the operation mode of the apparatus main body 10 from the bulk purchasing consumer mode to the standard mode. Thereafter, the controller 12 controls the image forming apparatus 1 while imposing the predetermined functional restriction similarly to step S24 (S43).

As described above, when the discounted item 20B is attached in the bulk purchasing consumer mode, it is determined whether or not the validity condition has fulfilled. When the validity condition is not determined to be fulfilled, the image forming apparatus 1 operates with all of the functions activated until the next replacement of the consumable item is performed. When the validity condition is determined to be fulfilled, on the other hand, the operation mode is switched from the bulk purchasing consumer mode to the standard mode, and then the image forming apparatus 1 operates with only the limited functions activated until the next replacement of the consumable item is performed.

When the consumable item code is not retrieved (none in S32), i.e. when the unapproved item 20D is attached, the controller 12 thereafter controls the image forming apparatus 1 while imposing the predetermined functional restriction similarly to step S29 (S44). As such, when the unapproved item 20D is attached in the bulk purchasing consumer mode, the image forming apparatus 1 operates with only the limited functions activated until the next replacement of the consumable item is performed.

According to the above-described embodiment, following effects can be obtained.

(1) In the present Embodiment 1, in addition to the ordinary consumable item, the switching item to switch between the operation modes is provided as one of the consumable items, and the switching of the operation mode of the apparatus main body is completed through the operation of attaching the switching item. Therefore, users are required to obtain the switching item from the dealer or the like when they attempt to switch between the operation modes. In this manner, the switching between the operation modes can be controlled on the dealer side, thereby preventing the operation modes being arbitrarily switched by users, while allowing the users to easily switch between the operation modes with effort similar to ordinary effort of replacing a consumable item. Consequently, the inconvenience for users of calling a CE every time they need to change the operation mode is eliminated, while the financial burden on the dealer or the like of sending the CE is avoided. As described above, according to the present embodiment, while limiting a degree of flexibility in user operation of switching between the operation modes, it is still possible to allow a user to complete the switching among the operation modes.

(2) Because, after the switching among the operation modes, the apparatus main body restores the previous operation mode before switching when the predetermined validity condition has fulfilled (specifically, upon expiration of the predetermined validity period), the operation mode can be automatically reset to the previous operation mode before switching. The automatic resetting eliminates the need for the dealer or the like to send the CE for resetting the operation mode, which is advantageous in terms of cost. On the other hand, the automatic resetting also eliminates the necessity for users to take on the task of resetting the operation mode or calling the CE, which is highly convenient for the users. Further, the operation mode can be restored more easily and at more precise timing by the automatic resetting compared with manual resetting.

(3) The switching item prestores validity condition information which indicates the validity condition of the operation mode after switching. The apparatus main body retrieves, when a switching item is attached, the validity condition information from the attached switching item, switches among the operation modes, and restores the previous operation mode before switching when the validity condition indicated by the retrieved validity condition information has fulfilled. Specifically, the switching item prestores validity period information which indicates the validity period of the operation mode after switching. The apparatus main body retrieves, when a switching item is attached, the validity period information from the attached switching item, switches among the operation modes, and restores the previous operation mode before switching when the validity period indicated by the retrieved validity period information has expired. Because the validity condition or period of the operation mode after switching is determined by the validity condition or period information specified to the switching item, the validity condition or period of the operation mode can be controlled on the dealer side. Specifically, the dealer or the like can control which degree of validity period is allocated to whom through the use of the validity condition or period information.

(4) In addition to the normal price item to be supplied at a normal price, the discounted item to be supplied at a reduced price to the bulk purchasing consumer is provided as one of the consumable items. The apparatus main body switchably includes, as the operation modes, the standard mode in which the functional restriction is imposed when the discounted item is attached and the bulk purchasing consumer mode in which the functional restriction is not imposed. According to this form, the apparatus main body set in the standard mode permits normal usage of the normal price item but prohibits the normal usage of the discounted item. On the other hand, the apparatus main body set in the bulk purchasing consumer mode permits the normal usage of both the normal price item and the discounted item. In other words, the normal usage of the discounted item is permitted only in the apparatus main body established in the bulk purchasing consumer mode. Therefore, according to the present embodiment, by changing the operation mode of the apparatus main body, it can be selected whether the normal usage of the discounted item is prohibited or permitted. More specifically, by setting an apparatus main body owned by the bulk purchasing consumer in the bulk purchasing consumer mode and other apparatus main bodies owned by other ordinary consumers in the standard mode, it is possible to permit the normal usage of the discounted item for the bulk purchasing consumer, while prohibiting the normal usage of the discounted item for the ordinary consumers. Consequently, in the sales form offering the consumable item at a lower price than the normal price to the bulk purchasing consumer, it is possible to prevent the discounted item directed at the bulk purchasing consumer being diverted to other consumers for their unauthorized use.

(5) Because the switching from the standard mode to the bulk purchasing consumer mode is achieved through the operation of attaching the switching item, arbitrary switching to the bulk purchasing consumer mode by the user can be prohibited, thereby enabling more reliable protection against the unauthorized use of the discounted item.

(6) After the switching among the operation modes is performed by attaching the switching item, the attached switching item is transformed to an ordinary consumable item. In this manner, the switching among the operation modes or the addition of the number of allowed uses achieved by the switching item can be limited to one time.

(7) After the switching to the bulk purchasing consumer mode, the apparatus main body restores the operation mode to the standard mode when the predetermined validity condition has fulfilled. Accordingly, the bulk purchasing consumer mode can be automatically released, which enables easy and precise control on the validity period of the bulk purchasing consumer mode. In this manner, it is possible to prevent the discounted items originally supplied to another customer being unlimitedly diverted for unauthorized use in the image forming apparatus set to the bulk purchasing consumer mode.

(8) In the present embodiment, the switching item retains the number of allowed uses of the discounted item. When the switching item is attached in the standard mode, the apparatus main body retrieves the number of allowed uses from the attached switching item, switches among the operation modes, and thereafter restores the operation mode to the standard mode when the use of the discounted item equivalent to the number of allowed uses is completed. In this manner, the number of discounted items usable in the bulk purchasing consumer mode can be controlled easily and precisely.

(9) When the switching item is attached in the bulk purchasing consumer mode, the apparatus main body retrieves the number of allowed uses from the attached switching item, switches among the operation modes, and thereafter restores the operation mode to the standard mode when the use of the discounted item equivalent to the sum of the numbers of allowed uses retrieved in both the standard mode and the bulk purchasing consumer mode is completed. Accordingly, during the course of operation in the bulk purchasing consumer mode, the number of discounted items usable in the bulk purchasing consumer mode can be added by the newly obtained number of allowed uses. In other words, the validity period of the bulk purchasing consumer mode can be extended during the course of operation in the bulk purchasing consumer mode.

(10) When the number of allowed uses is added by attaching the switching item, the attached switching item is transformed to an ordinary consumable item, which can cause the switching among the operation modes or the addition of the number of allowed uses achieved by the switching item to be limited to one time.

(11) When the number of discounted items usable in the bulk purchasing consumer mode is determined to be smaller than or equal to the predetermined value, this determination is notified, thereby allowing the user to understand that the number of discounted items usable in the bulk purchasing consumer mode becomes low, which in turn allows the user to take appropriate action.

Embodiment 2

Figure 7:
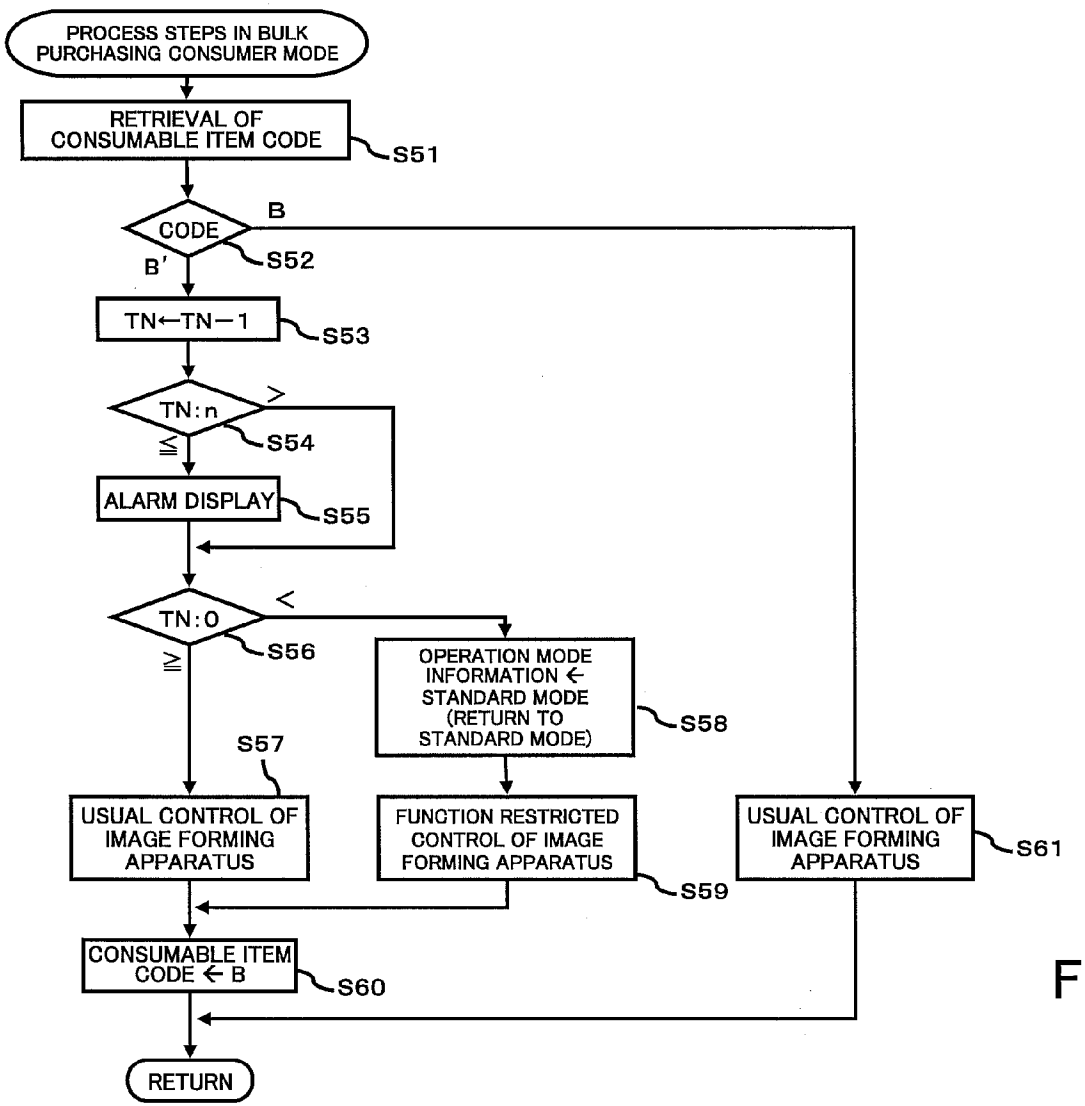
FIG. 7 is a flowchart showing process steps in a bulk purchasing consumer mode according to a second embodiment of the present invention.

FIG. 7 is a flowchart showing process steps in the bulk purchasing consumer mode according to a second embodiment of the present invention. Referring to FIG. 7, Embodiment 2 will be described below. It should be noted that as the present Embodiment 2 is almost the same as the previous Embodiment 1, components similar to those of Embodiment 1 are identified by the same reference numeral and description thereof is not repeated. Further, a flow of process steps performed when the consumable item code is "A", "C", or "none" are not depicted in FIG. 7.

In Embodiment 2, the consumable item code "B'" is stored in the consumable item memory 21 of the discounted item in factory-shipped settings. Here, the discounted item to which the consumable item code "B'" is specified is referred to as an unused discounted item.

When the unused discounted item is attached to the apparatus main body 10, the controller 12 operates similarly to as shown in the process steps S31 and S32 and process steps from S37 to S43 of FIG. 6 (S51 to S59), and rewrites the consumable item code in the consumable item memory 21 replacing "B'" with "B" (S60). Consequently, the discounted item which has already caused the allowed number counter value TN to be decremented once is distinguished from the unused discounted item which has not caused the decrementing yet. Here, the discounted item with the consumable item code "B" is referred to as a used discounted item.

When the used discounted item is attached to the apparatus main body 10, as shown in FIG. 7, the controller 12 does not perform the process steps of the decrementing, and thereafter controls the image forming apparatus 1 in the usual way without imposing the functional restriction (S61).

It should be noted that the above-described unused discounted item is not distinguished from the used discounted item in the standard mode, and the functional restriction is imposed regardless of whether the unused discounted item or the used discounted item is attached.

Although the unused and used discounted items are distinguished by the consumable item codes in the above description, a distinction between the unused and used discounted items may be made based on appropriate information, such as a flag for indicating whether or not it is to be used, or the like.

As described above, when the allowed number counter value is decremented in response to the attachment of the discounted item, the apparatus main body according to the present Embodiment 2 stores information about the decrementing of the allowed number counter value in the attached discounted item, and does not decrement the allowed number counter value further as long as the discounted item having the information is attached. Therefore, according to Embodiment 2, it is possible to prevent the allowed number counter value being decremented plural times by the repeated attachment and removal of the same discounted item.

Although examples of switching the operation mode between the standard mode and the bulk purchasing consumer mode are described in previous Embodiment 1 and the present Embodiment 2, the switching between the operation modes is not limited to those described above. For example, the operation mode may be switched between an unapproved item prohibiting mode in which the use of an unapproved item is prohibited, and an unapproved item permitting mode in which the use of an unapproved item is permitted. Alternatively, the operation mode may be switched between an operation mode in which predetermined additional functions are disabled, and an operation mode in which the predetermined additional functions are enabled.

Further, the storage of the switching information and the validity condition information retained in the consumable item 20 is not limited to the above-described semiconductor memory, and the switching information and the validity condition information may be retained in the consumable item 20 using other appropriate memories, such as a magnetic memory, an optical memory, or the like. A fuse may be provided to the consumable item 20 itself or the memory for the consumable item 20, and may be burned-out when the memory in the consumable item 20 is rewritten by the image forming apparatus in order to limit the rewriting of the memory in the consumable item 20 to one time as protection against unauthorized use of the consumable item 20.

In addition, a program for controlling the image forming apparatus may be stored in the memory of the switching item 20C, to cause, upon detection of new attachment of the switching item 20C, the image forming apparatus to install the program from the switching item 20C to run the program. For example, the switching item 20C including the program may be attached to an image forming apparatus which is configured to operate only in the standard mode, thereby reconfiguring the image forming apparatus so as to operate in the operation mode switched between the standard mode and the bulk purchasing consumer mode.

In Embodiments 1 and 2, completion of the use of the discounted item 20B equivalent to the number of allowed uses after the switching of the operation modes is specified as a predetermined validity condition. The predetermined validity condition may be defined appropriately by another condition, such as a lapse of predetermined years from the switching, expiration of due date, printing of a predetermined number of sheets after the switching, or the like. In other words, although the time period from the switching between the operation modes to the time when the use of the discounted item 20B equivalent to the number of allowed uses is completed is established as the predetermined validity period in Embodiments 1 and 2, a time period of predetermined years after the switching, a time period to an established date, a time period from the switching until printing of a predetermined number of sheets is completed, or the like may be defined as the predetermined validity period as appropriate.

Further, the predetermined validity condition which is determined based on the validity condition information established in the consumable item 20C in Embodiments 1 and 2 may be previously set in the apparatus main body 10. In this case, the validity condition information may be omitted from the consumable item 20.

Embodiment 3

Figure 8:
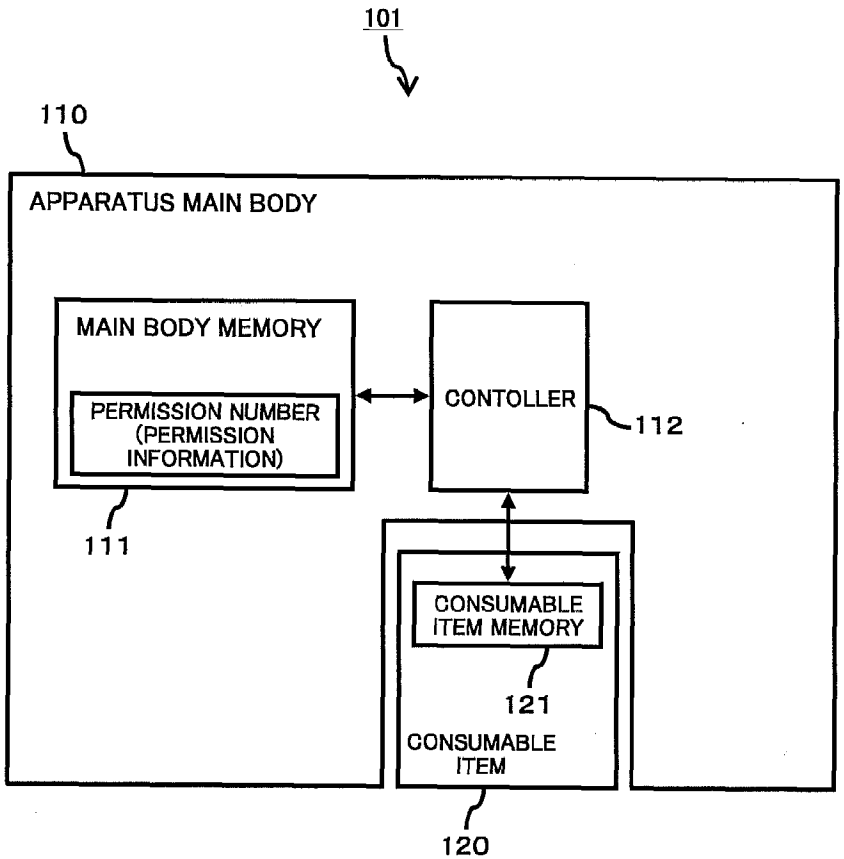
FIG. 8 is a block diagram showing a configuration of an image forming apparatus according to a third embodiment of the present invention.

FIG. 8 is a block diagram showing a configuration of an image forming apparatus 101 according to a third embodiment of the present invention. Similarly to a copier, a printer, a facsimile machine, a multifunction digital machine, and the like, the image forming apparatus 101 forms an image on a recording medium, such as paper. An electrophotographic printing method or inkjet printing method may be adopted as a printing method for the image forming apparatus 101.

In FIG. 8, the image forming apparatus 101 includes an image forming apparatus main body (hereinafter referred to as "an apparatus main body") 110 and a consumable item

120 removably attached to the apparatus main body 110. The apparatus main body 110 cooperates with the consumable item 120 to form an image.

The apparatus main body 110 is a substantially stationary part in the image forming apparatus 101, while the consumable item 120 is generally a replacement part to be appropriately replaced when depleted, and may include, for example, a photosensitive unit, a toner bottle, an ink cartridge, and the like.

The consumable item 120 is, as shown in FIG. 8, equipped with a consumable item memory 121 which is a non-volatile storage device. Here, the consumable item memory 121 is a semiconductor memory contained in an RFID (Radio Frequency Identification) tag, and data is read or written through wireless communication from or to the consumable item memory 121. Further, the consumable item memory 121 also works as a memory in which control information, such as a correction value for compensating unevenness in production quality, a usage history, and others is stored.

Figure 9:
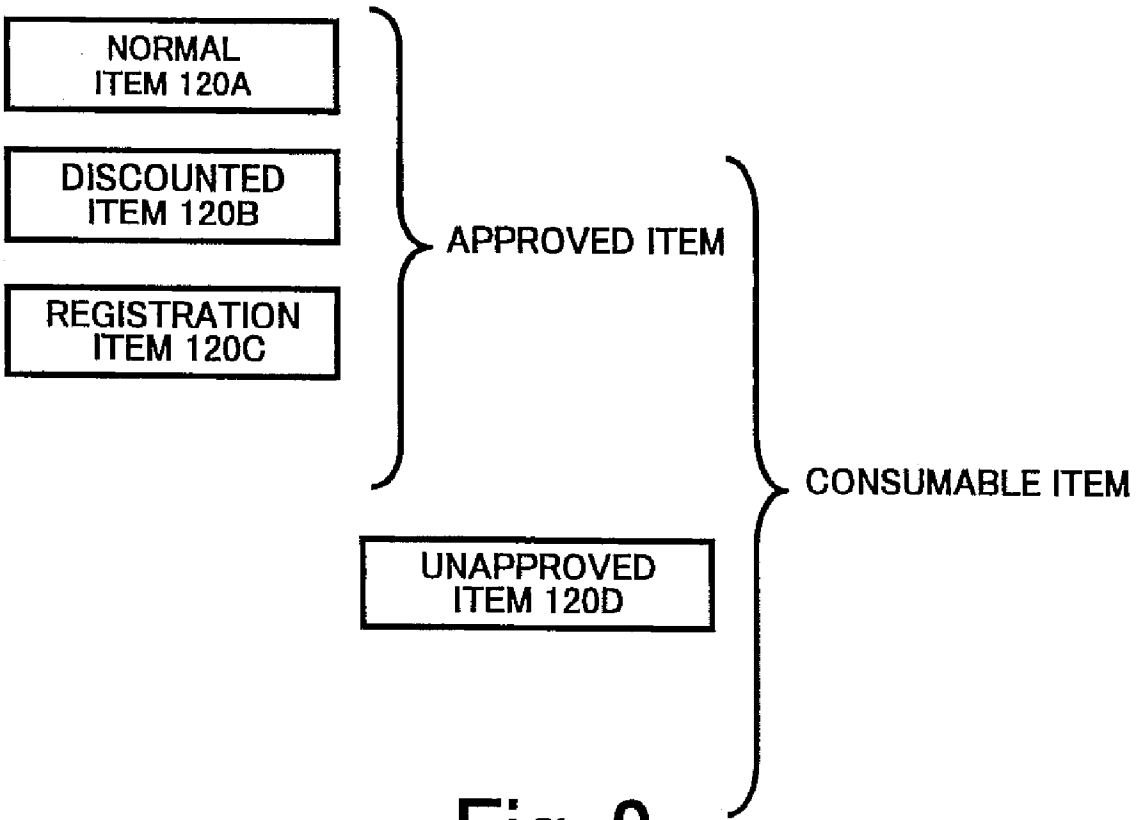
FIG. 9 is a diagram showing types of consumable items in the third embodiment.

Types of the consumable item.120 according to the present Embodiment 3 and information prestored in the consumable item memory 121 will be described below. As distinct from composition of the types of the consumable item 20 according to Embodiments 1 and 2, a normal item 120A, a discounted item 120B, and a registration item 120C are provided as a consumable item 120 in Embodiment 3, as shown in FIG. 9.

The normal item 120A is an ordinary consumable item offered at a normal price, and all users are allowed to use the normal item 120A. The consumable item memory 121 in the normal item 120A stores a consumable item code "AA" representing the type of the normal consumable item as shown in FIG. 10.

The discounted item 120B is a discounted consumable item offered to a bulk purchasing consumer (a large account, a heavy user) at a reduced price, and is also a special consumable item the use of which is limited to a specific user (a bulk purchasing consumer). The consumable item memory 121 in the discounted item 120B stores a consumable item code "BB" representing a type of the discounted consumable item along with identification information for usage control. Here, the consumable item memory 121 in the discounted item 120B stores a five-digit serial number which is individual identification information uniquely allocated to each discounted item 120B, and the upper four digits in the serial number function as the identification information for usage control. It should be noted that the discounted item 120B is given a serial number in which the lowest digit is any number from 1 to 9, and a serial number having 0 at the lowest digit is not given to the discounted item 120B.

The registration item 120C is a consumable item for permission information registration used for entering, in the apparatus main body 110, the permission information to allow the use of the discounted item 120B having specific identification information. The consumable item memory 121 in the registration item 120C stores, as shown in FIG. 10, the permission information which indicates at least one set of the identification information for usage control along with a consumable item code "CC" representing a type of the consumable item for permission information registration. Here, the consumable item memory 121 in the registration item 120C stores a five-digit serial number which is individual identification information uniquely allocated to each registration item 120C. The five-digit serial number functions as permission information and has upper four digits which denote the identification information for usage control. The registration item 120C is given a serial number having 0 at the lowest digit. The registration item 120C is offered to an apparatus user along with the discounted item 120B having the identification information identical to that of the registration item 120C.

The normal item 120A, the discounted item 120B, and the registration item 120C described above are consumable items, such as genuine parts, recommended parts, and the like, the use of which is approved by a manufacturer of the apparatus main body 110 (hereinafter referred to "an approved item"). In the actual market, there have been distributed, as well as the approved items, third-vendor parts, third-party parts, counterfeits, fakes, pirated goods, etc., which are consumable items 120D the use of which is not approved by the manufacturer of the apparatus main body 110 (hereinafter referred to as "an unapproved item"). The unapproved item 120D does not have a consumable item code assigned thereto. In addition, some unapproved items 120D may not have a memory like the consumable item memory 121.

The apparatus main body 110 includes a main body memory 111 and a controller 112 as shown in FIG. 8. The main body memory 111 is a storage device in which permission information indicating identification information of the discounted item 120B the use of which is allowed in the apparatus main body 110 is registered and retained, and may be a rewritable nonvolatile memory, such as an NVRAM (Non Volatile RAM), a nonvolatile register, or the like. Here, the main body memory 111 does not include the permission information in initial settings (at factory-shipped point).

The controller 112 controls the entire image forming apparatus 101 including a print engine and a user interface which are not illustrated. In particular, the controller 112 according to Embodiment 3 retrieves, when the registration item 120C is attached, the permission information from the attached registration item 120C, and registers and retains the retrieved permission information. When the discounted item 120B is attached, the controller 112 retrieves the identification information for usage control from the attached discounted item 120B and determines whether or not the retrieved identification information matches any one of the at least one set of the identification information indicated by the registered and retained permission information. When matching is not determined, the predetermined functional restriction is imposed, while when matching is determined, the predetermined functional restriction is not imposed.

More specifically, when the registration item 120C is attached, the controller 112 reads the serial number from the consumable item memory 121 in the attached registration item 120C, and registers the upper four digits in the read serial number as an permission number in the main body memory 111. Here, plural permission numbers may be registered in the main body memory 111, and, when multiple registration items 120C are attached to the apparatus main body 110, plural permission numbers are registered in the main body memory 111.

On the other hand, when the discounted item 120B is attached, the controller 112 retrieves the serial number from the consumable item memory 121 in the attached discounted item 120B, and determines whether or not the upper four digits in the retrieved serial number match the permission number registered in the main body memory 111. If they do not match, the predetermined functional restriction that disables, for example, recording of water mark, recording at a predetermined density or higher, and the like, is imposed, while when they match, the predetermined functional restriction is not imposed. Here, functions to be disabled may be decided taking into account the discount rate or the like, as appropriate. The predetermined functional restriction may include partially disabling the functions of the image forming apparatus 101 other than the image forming capability, partially disabling the functions of the image forming apparatus 101 including the image forming capability, disabling all of the functions of the image forming apparatus 101, and the like.

The controller 112 is a circuit substrate on which a CPU, ROM, RAM, and other devices are mounted, and the function of the controller 112 is implemented by causing the CPU to run a program stored in a storage medium, such as a ROM. However, how the function of the controller 112 is implemented is not specifically limited, and the function of the controller 112 may be realized by a special-purpose hardware circuit, for example.

Figure 11:
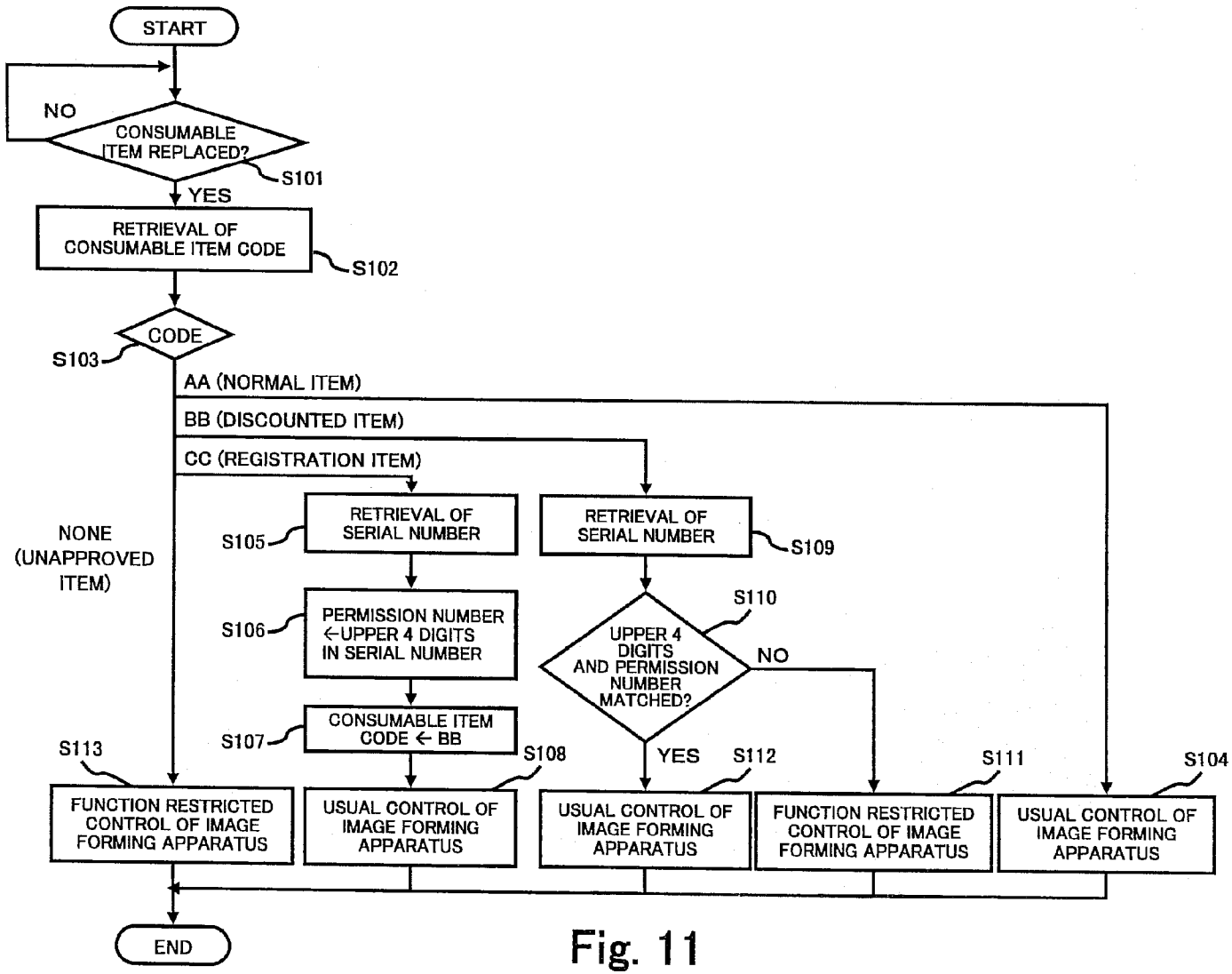
FIG. 11 is a flowchart showing operation procedure of a controller.

FIG. 11 is a flowchart showing process steps of the controller 112. Next, operation of the image forming apparatus 101 will be described in detail with reference to FIG. 11. As general image forming operations of the image forming apparatus 101 are commonly known, the description thereof will not be provided below.

In FIG. 11, when replacement of the consumable item 120 is detected by an appropriate detector (Yes in S101), the controller 112 reads the consumable item code from the consumable item memory 121 in the attached consumable item 120 via a reader/writer (not illustrated) (S102) to find the consumable item code of the attached consumable item 120 (S103).

When the consumable item code is found to be "AA" (AA in S103), i.e. when the normal item 120A is attached, the controller 112 thereafter controls the image forming apparatus 101 in the usual way without functional restriction (S104). As described above, after the normal item 120A is attached, the image forming apparatus 101 operates with all of the functions activated until the next replacement of the consumable item is performed.

When the consumable item code is found to be "CC" (CC in S103), i.e. when the registration item 120C is attached, the controller 112 reads the serial number from the consumable item memory 121 (S105), and registers the upper four digits in the read serial number as an permission number in the main body memory 111 (S106).

Next, the controller 112 rewrites the consumable item code retained in the consumable item memory 121 replacing "CC" with "BB" (S107). Consequently, the permission information retained in the registration item 120C becomes void to thereby limit the number of times the registration item 120C can be used as the consumable item for permission information registration to one time. Although the consumable item code is replaced with "BB", the code may be replaced with "AA".

After the above process steps are completed, the controller 112 controls the image forming apparatus 101 in the usual way without imposing the functional restriction (S108).

As described above, when the registration item 120C is attached, the permission information established in the attached registration item 120C is registered in the apparatus main body 110, and the image forming apparatus 101 operates with all of the functions activated until next replacement of the consumable item is performed.

When the consumable item code is found to be "BB" (BB in S103), i.e. when the discounted item 120B is attached, the controller 112 reads the serial number from the consumable item memory 121 (S109). Then, the controller 112 determines whether or not upper four digits in the read serial number match any one of the permission numbers registered in the main body memory 111 (S110).

When matching is not determined (No in S110), the controller 112 thereafter controls the image forming apparatus 101 while restricting predetermined functions (S111). Here, the controller 112 maintains the image forming capability but disables other additional functions. Here, the functions to be disabled are decided as appropriate taking into account the discount rate and the like.

When matching is determined (Yes in S110), on the other hand, the controller 112 thereafter controls the image forming apparatus 101 in the usual way without restricting the functions (S112).

As described above, when the discounted item 120B is attached, whether or not the upper four digits in the serial number of the attached discounted item 120B match the permission number registered in the apparatus main body 110 is determined. When matching is not determined, the image forming apparatus 101 operates with only limited functions activated until the consumable item will be replaced next. When matching is determined, on the other hand, the image forming apparatus 101 operates with all of the functions activated until the consumable item is next replaced.

When the consumable item code is not retrieved (none in S103), i.e. when the unapproved item 120D is attached, the controller 112 thereafter controls the image forming apparatus 101 while restricting the predetermined functions (S113). Here, while maintaining the image forming capability in an enabled state, the controller 112 disables other additional functions. The functions to be disabled here are determined appropriately in view of preventing disadvantages associated with the use of the unapproved item 120D (a failure of the apparatus main body 110, a problem of poor image quality, a degraded safety level). The functional restriction imposed in step S113 may either be similar to or different from that imposed in the previous step S111. As described above, when the unapproved item 120D is attached, the image forming apparatus 101 operates with only the limited functions activated until the consumable item is next replaced.

Because operation is performed as described above, prohibition or permission of normal usage of the discounted item 120B is controlled in the image forming apparatus 101 according to the present Embodiment 3 as described below. Specifically, because the permission number is not registered in the apparatus main body 110 in the initial settings (at factory-shipped point), the functional restriction is imposed when every one of the discounted items 120B is attached. In other words, the normal usage of the discounted items 120B is prohibited.

When the registration item 120C having a serial number of, for example, "12340" is attached to the apparatus main body 110 in the initial settings, an permission number "1234" is registered in the apparatus main body 110.

The apparatus main body 110 in which the permission number "1234" is registered permits the normal usage of discounted items 120B having serial numbers from "12341" to "12349".

According to the above-described Embodiment 3, the following effects can be obtained.

(1) In the present Embodiment 3, there are provided, as a consumable item, the special consumable item which prestores identification information for usage control and the consumable item for permission information registration which prestores the permission information indicating at least one set of the identification information in addition to the normal consumable item. When the consumable item for permission information registration is attached, the apparatus main body obtains permission information from the attached consumable item, and registers and retains the obtained permission information. When the special consumable item is attached, on the other hand, the apparatus main body obtains identification information from the attached special consumable item, determines whether or not the obtained identification information matches any one of the at least one set of the identification information indicated by the registered and retained permission information, and restricts the predetermined functions when matching is not found, or does not restrict the predetermined functions when matching is found. In this manner, prohibition and permission of the normal usage of the special consumable item can be controlled with the simple configuration according to this embodiment. In other words, the usage control of the special consumable item can be implemented with the simple configuration.

(2) With the configuration in which the permission information is registered in the apparatus main body by attaching the consumable item for permission information registration, a user is capable of registering the permission information in an easy manner similar to a normal manner for replacing a consumable item.

(3) Because the permission information is registered in the apparatus main body when the consumable item for permission information registration is attached, a user needs to obtain the consumable item for permission information registration from the dealer or the like in order to register the permission information. Therefore, it is possible to prevent a user arbitrarily registering the permission information.

(4) Because the permission information is registered upon the attachment of the consumable item for permission information registration, the dealer or the like can easily control who is allowed to use which one of the special consumable items.

(5) Because, in the sales form for providing consumable items to bulk purchasing consumers at a reduced price, the discounted consumable item is offered at the reduced price on condition of mass consumption, it is not preferable for the discounted consumable items offered to the bulk purchasing consumers to be diverted for use by other ordinary consumers. With this in mind, the above-described discounted consumable items offered to the bulk purchasing consumers are specified as special consumable items and targeted for usage control in this embodiment. Accordingly, it is possible to prevent the discounted consumable items offered to the bulk purchasing consumer being diverted to other ordinary consumers for unauthorized use.

(6) When the permission information is registered by the attachment of the consumable item for permission information registration, the permission information retained in the attached consumable item for registration is overridden. Consequently, the registration of the permission information performed by the consumable item for permission information registration is limited to one time only.

It should be noted that the identification information for usage control is not limited to the above-described upper four digits in the serial number, and any information may be used as the identification information as long as the information can provide identification of a specific discounted item 120B or a series of discounted items composed of multiple specific discounted items 120B.

Further, the permission information is not limited to the serial number, and may be any kind of information as long as at least one set of identification information for usage control can be identified by the information. One modification example of such permission information will be described below. In this modification example, the permission information composed of a start number and a set count of items indicates, as the identification information, numbers from the start number to the last number [=(the start number)+(the set count of items)−1]. For example, the permission information having the start number of "12341" and the set count of items of "100" indicates numbers from "12341" of the start number to "12440" of the last number as the identification information. Accordingly, the apparatus main body 110 in which this permission information is registered permits the normal usage of 100 discounted items 120B having the serial numbers from "12341" to "12440".

The storage of the identification information for usage control and the permission information retained in the consumable item 120 is not limited to the above-described semiconductor memory, and the identification information for usage control and the permission information may be stored in the consumable item 120 using another appropriate storage, such as a magnetic memory, an optical memory, or the like. A fuse may be provided in the consumable item 120 itself or the memory and may be burned-out when the memory in the consumable item 120 is rewritten by the apparatus main body 110, to thereby limit the rewriting of the memory in the consumable item 120 performed by the apparatus main body 110 to one time for protection against unauthorized use of the consumable item 120.

In addition, a program for controlling the apparatus main body 110 may be stored in the memory of the registration item 120C, and, upon detection of new attachment of the registration item 120C, the apparatus main body 110 may install the program from the registration item 120C to run the program. For example, by setting the registration item 120C including the program in the apparatus main body 110 configured to always prohibit the normal usage of the discounted item 120B, the apparatus main body 110 can be reconfigured to register and retain the permission information for permitting the normal usage of the specific discounted item 120B.

Further, another type of consumable item 120E (not illustrated) may be used for causing the apparatus main body 110 to delete all of the permission information registered in the apparatus main body 110 upon detection of the identification information of the consumable item 120E. In this manner, the memory in the apparatus main body 110 can be used in an efficient manner. Further, the control program may be uninstalled from the apparatus main body 110 when the apparatus main body 110 detects the identification information of the consumable item 120E, to thereby restore the apparatus main body 110 to a normal state upon expiration of the term of contract regarding the discounted consumable item.

Further, the special consumable item targeted for usage control is not limited to the above-described discounted consumable item, and the usage control may be applied to other types of consumable items, the use of which is intended for a specific user.

It is to be understood that the present invention is not limited to the specific embodiments thereof, and various changes and modifications may be made within departing from the spirit or scope of this invention.

The entire disclosure of Japanese Patent Applications No. 2005-067031 filed on Mar. 10, 2005 and No. 2005-086025 filed on Mar. 24, 2005 including the specification, claims, drawings and abstract is incorporated herein by reference.

What is claimed is:

1. An image forming apparatus main body for forming an image on a recording medium in at least two operations modes, by using consumable items removably attached thereto, the image fonning apparatus main body comprising:

a communicating unit that communicates with a consumable item which retains switching information to change the operation mode of the image forming apparatus main body; and a controller that switches the operation mode of the image forming apparatus main body from a first mode of the image forming apparatus main body to a second mode when the consumable item, which retains switching information, is attached to the image forming apparatus main body, and restores the operation mode of the image forming apparatus main body to the first mode when a predetermined validity condition has fulfilled; wherein the first mode is a mode in which a functional restriction is imposed when a consumable item of a first type is attached to the image forming apparatus main body and the functional restriction is not imposed when a consumable item of a second type is attached to the image forming apparatus main body, and the second mode is a mode in which the functional restriction is not imposed when the consumable item of the first type or of the second type is attached to the image forming apparatus main body, and the first mode and the second mode are modes in which an image is formed.

2. The image forming apparatus main body according to claim 1, wherein:

the consumable item, which retains switching information, retains validity condition information indicating a validity condition of the operation mode; and the controller retrieves the validity condition information from the attached consumable item when the consumable item, which retains switching information, is attached, switches the operation mode from the first mode to the second mode, and restores the operation mode to the first mode when a predetermined validity condition indicated by the retrieved validity condition information has been fulfilled.

3. The image forming apparatus main body according to claim 1, wherein:

the first mode is a standard mode in which a functional restriction is imposed when a discounted consumable item which is offered at a reduced price to a bulk purchasing consumer is attached, and the second mode is a bulk purchasing consumer mode in which the functional restriction is not imposed when the discounted consumable item is attached; and the controller switches from the standard mode to the bulk purchasing consumer mode when the consumable item, which retains switching information, is attached, and switches the operation mode from the bulk purchasing consumer mode to the standard mode when a predetermined validity condition has been fulfilled.

4. The image forming apparatus main body according to claim 3, wherein:

the consumable item, which retains switching information, retains, as the validity condition information, the number of allowed uses of the discounted consumable item; and when, in the standard mode, the consumable item, which retains switching information, is attached, the controller switches the operation mode from the standard mode to the bulk purchasing consumer mode, retrieves the number of allowed uses from the consumable item, which retains switching information, and restores the operation mode to the standard mode when use of the discounted consumable item equivalent to the number of allowed uses is completed.

5. The image forming apparatus main body according to claim 4, wherein:

when, in the bulk purchasing consumer mode, the consumable item which retains switching information is attached, the controller retrieves the number of allowed uses from the consumable item, which retains switching information, and restores the operation mode to the standard mode when use of the discounted consumable item equivalent to a sum of the number of allowed uses obtained in the standard mode and the number of allowed uses obtained in the bulk purchasing consumer mode is completed.

6. An image forming apparatus in which an image forming apparatus main body forms an image on a recording medium in at least two operation modes, by using consumable items removably attached thereto, the image forming apparatus comprising:

a consumable item that retains switching information to change the operation mode of the image forming apparatus main body; and a controller that switches the operation mode of the image forming apparatus main body from a first mode to a second mode when the consumable item, which retains switching information, is attached to the image forming apparatus main body, and restores the operation mode of the image forming apparatus main body to the first mode when a predetermined validity condition has fulfilled; wherein the first mode is a mode in which a functional restriction is imposed when a consumable item of a first type is attached to the image forming apparatus main body and the functional restriction is not imposed when a consumable item of a second type is attached to the image forming apparatus main body, and the second mode is a mode in which the functional restriction is not imposed when the consumable item of the first type or of the second type is attached to the image forming apparatus main body, and the first mode and the second mode are modes in which an image is formed.

7. The image forming apparatus according to claim 6, wherein:

the consumable item, which retains switching information, retains validity condition information indicating a validity condition of the operation mode; and the controller retrieves the validity condition information from the attached consumable item when the consumable item, which retains switching information, is attached, switches the operation mode from the first mode to the second mode, and restores the operation mode to the first mode when a predetermined validity condition indicated by the retrieved validity condition information has been fulfilled.

8. The image forming apparatus according to claim 6, wherein:

the first mode is a standard mode in which a functional restriction is imposed when a discounted consumable item which is offered at a reduced price to a bulk purchasing consumer is attached, and the second mode is a bulk purchasing consumer mode in which the functional restriction is not imposed when the discounted consumable item is attached; and the controller switches from the standard mode to the bulk purchasing consumer mode when the consumable item, which retains switching information, is attached, and switches the operation mode from the bulk purchasing consumer mode to the standard mode when a predetermined validity condition has been fulfilled.

9. The image forming apparatus according to claim 8, wherein:

the consumable item, which retains switching information, retains, as the validity condition information, the number of allowed uses of the discounted consumable item; and when, in the standard mode, the consumable item, which retains switching information, is attached, the controller switches the operation mode from the standard mode to the bulk purchasing consumer mode, retrieves the number of allowed uses from the consumable item, which retains switching information, and restores the operation mode to the standard mode when use of the discounted consumable item equivalent to the number of allowed uses is completed.

10. The image forming apparatus according to claim 9, wherein:

when, in the bulk purchasing consumer mode, the consumable item which retains switching information is attached, the controller retrieves the number of allowed uses from the consumable item, which retains switching information, and restores the operation mode to the standard mode when use of the discounted consumable item equivalent to a sum of the number of allowed uses obtained in the standard mode and the number of allowed uses obtained in the bulk purchasing consumer mode is completed.

11. An image forming apparatus in which an image forming apparatus main body forms an image on a recording medium using consumable items removably attached thereto, comprising:

a consumable item;

a controller; and a memory;

wherein in addition to an ordinary consumable item, a special consumable item which prestores, before being attached to the image forming apparatus main body, identification information assigned to the consumable item and for usage control, and a consumable item for permission information registration which prestores permission information indicating at least one set of the identification information assigned to a consumable item which differs from the consumable item for permission information registration are provided as one of the consumable items;

when the consumable item for permission information registration is attached to the image forming apparatus main body, the controller retrieves the permission information from the attached consumable item for permission information registration, and stores the retrieved permission information in the memory; and when the special consumable item is attached to the image forming apparatus main body, retrieves the identification information from the attached special consumable item, the controller determines whether or not the retrieved identification information matches any one of the at least one set of the identification information indicated by the permission information stored in the memory, and imposes a predetermined functional restriction when matching is not determined, or does not imposes the predetermined functional restriction when matching is determined.

12. The image forming apparatus according to claim 11, wherein the special consumable item is a discounted consumable item to be offered at a reduced price to a bulk purchasing consumer.

13. An image forming apparatus main body which forms an image on a recording medium using consumable items removably attached thereto, comprising:

a controller; and a memory;

wherein in addition to an ordinary consumable item, a special consumable item which prestores, before being attached to the image forming apparatus main body, identification information assigned to the consumable item and for usage control, and a consumable item for permission information registration which prestores permission information indicating at least one set of the identification information assigned to a consumable item which differs from the consumable item for permission information registration are provided as one of the consumable items;

when the consumable item for permission information registration is attached to the image forming apparatus main body, the controller retrieves the permission information from the attached consumable item for permission information registration, and stores the retrieved permission information in the memory; and when the special consumable item is attached to the image forming apparatus main body, retrieves the identification information from the attached special consumable item, the controller determines whether or not the retrieved identification information matches any one of the at least one set of the identification information indicated by the permission information stored in the memory, and imposes a predetermined functional restriction when matching is not determined, or does not imposes the predetermined functional restriction when matching is determined.

14. The image forming apparatus main body according to claim 13, wherein the special consumable item is a discounted consumable item to be offered at a reduced price to a bulk purchasing customer.

* * * * *